US010876259B2

(12) United States Patent
Kleinvachter

(10) Patent No.: US 10,876,259 B2
(45) Date of Patent: Dec. 29, 2020

(54) CROSS SLOPE MONITORING SYSTEM

(71) Applicant: Caterpillar Paving Products Inc., Brooklyn Park, MN (US)

(72) Inventor: Brent R. Kleinvachter, Clear Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/008,120

(22) Filed: Jun. 14, 2018

(65) Prior Publication Data

US 2019/0382967 A1 Dec. 19, 2019

(51) Int. Cl.

| | |
|---|---|
| ***E01C 23/06*** | (2006.01) |
| ***E01C 23/01*** | (2006.01) |
| ***E01C 19/48*** | (2006.01) |

(52) U.S. Cl.

CPC ..... *E01C 23/01* (2013.01); *E01C 19/48* (2013.01)

(58) Field of Classification Search

CPC ..... E01C 19/48
USPC ..... 404/84.8
See application file for complete search history.

(56) References Cited

U.S. PATENT DOCUMENTS 3,602,113 A * 8/1971 Davin ..... E01C 19/4873 404/84.2
3,872,601 A * 3/1975 Burgin ..... E01C 19/4873 200/61.45 R
4,925,340 A * 5/1990 Heiser ..... E01C 19/004 404/118
5,101,360 A * 3/1992 Bennett ..... E01C 19/48 404/119
5,401,115 A 3/1995 Musil et al.
5,851,086 A * 12/1998 Kurasako ..... B60B 39/00 404/94
5,941,658 A * 8/1999 Dahlinger ..... E01C 19/008 172/4.5
6,109,825 A 8/2000 Yon
7,226,239 B2 * 6/2007 Stridiron ..... E01C 19/288 404/84.05
7,422,391 B2 * 9/2008 Holl ..... E01C 23/088 299/1.5
8,033,751 B2 10/2011 Yost
(Continued)

FOREIGN PATENT DOCUMENTS

CN 2775111 Y 4/2006

*Primary Examiner* — Thomas B Will
*Assistant Examiner* — Katherine J Chu
(74) *Attorney, Agent, or Firm* — Calfee, Halter & Griswold LLP

(57) ABSTRACT

A cross slope monitoring system for a paver having a screed assembly, a first tow point lift cylinder, and a second tow point lift cylinder. The system includes a first tow point lift cylinder sensor associated with the first tow point lift cylinder and configured to send a first signal indicative of the position of the first tow point lift cylinder, a second tow point lift cylinder sensor associated with the first tow point lift cylinder and configured to send a second signal indicative of the position of the second tow point lift cylinder, and a processor, The processor configured to determine the cross slope of the screed assembly based on the first signal and the second signal, compare the determined cross slope to a cross slope threshold, and generate a response if the determined cross slope is equal to or greater than the cross slope threshold.

17 Claims, 4 Drawing Sheets

(56) References Cited

U.S. PATENT DOCUMENTS

| | | | | |
|---|---|---|---|---|
| 8,038,366 | B2 | 10/2011 | Halonen et al. | |
| 8,371,769 | B2 * | 2/2013 | Worsley | E01C 23/07 404/118 |
| 8,672,581 | B2 * | 3/2014 | Berning | E01C 21/00 299/1.5 |
| 8,747,022 | B1 * | 6/2014 | Case | E01C 19/48 404/118 |
| 9,045,871 | B2 * | 6/2015 | Graham | E01C 19/4873 |
| 9,631,329 | B2 | 4/2017 | Fritz et al. | |
| 9,873,991 | B2 * | 1/2018 | Fritz | E01C 19/42 |
| 10,358,779 | B2 * | 7/2019 | Comer | E01C 19/48 |
| 10,428,472 | B1 * | 10/2019 | Worsley | E01C 19/006 |
| 10,496,106 | B2 * | 12/2019 | Dahm | B62D 11/20 |
| 2003/0161684 | A1 * | 8/2003 | Quenzi | E01C 19/006 404/75 |
| 2014/0119826 | A1 * | 5/2014 | Graham | E01C 19/42 404/75 |
| 2015/0063907 | A1 * | 3/2015 | Graham | E01C 23/07 404/84.1 |
| 2017/0073907 | A1 * | 3/2017 | Jennings | E01C 19/42 |
| 2017/0233958 | A1 * | 8/2017 | Utterodt | E01C 19/48 701/50 |
| 2019/0063474 | A1 * | 2/2019 | Brinkman | F15B 19/005 |
| 2019/0082598 | A1 * | 3/2019 | Seiders, Jr. | A01D 41/141 |
| 2019/0107467 | A1 * | 4/2019 | Case | G01N 1/08 |
| 2019/0113057 | A1 * | 4/2019 | Olsson | F15B 11/048 |
| 2019/0176559 | A1 * | 6/2019 | Bittner | B60G 17/0165 |
| 2019/0178371 | A1 * | 6/2019 | Weinhardt | F15B 1/033 |
| 2019/0193816 | A1 * | 6/2019 | Van Der Burg | B63B 21/20 |

* cited by examiner

CROSS SLOPE MONITORING SYSTEM

TECHNICAL FIELD

The present disclosure relates generally to pavers of the floating screed type, and more particularly, to a paver having a system that monitors cross slope of the screed assembly and can generate a response based on the amount of cross slope.

BACKGROUND

"Floating screed" pavers are generally known to those skilled in the art and provide a method of coating an old or new roadway with a compacted layer of paving material, such as asphalt aggregate. "Floating screed" pavers typically include a tractor having a hopper at its front end for receiving paving material and a floating screed attached to its rear end. A conveyor system on the machine transfers the paving material from the hopper rearwardly for distribution in front of a floating screed.

The screed "floats" by virtue of being connected to the tractor by a pair of pivoted tow arm, mounted on opposite sides of the tractor, such that the screed physically levels any paving material lying higher than a predetermined height above the roadway surface. The tow arms of the screed are attached to the tractor at a "tow point." In modern paver designs, the tow point can be moved vertically, typically via hydraulic cylinders, causing a corresponding movement in the tow arms and screed. If the tow point on one side of the tractor is raised higher that the tow point on the other side of the tractor, the screed will be in cross slope. There are situations during the paving process when the screed will need to be placed in cross slope. For example, the screed will be placed in cross slope during a continuous pull transitioning from paving straight to going around a corner.

In the system of U.S. Published Patent Application No. 2017/0233958 to Utterodt et al., a paving machine is disclosed having a screed assembly with a left screed section and a right screed section. The paving machine may have a crown profile sensor configured to detect the crown profile and a cross slope sensor configured to detect a cross slope of the screed assembly. Further, the paving machine may have a processor configured to determine the crown profile and a cross slope of the screed assembly. The processor may calculate a left cross slope of the left screed section and a right cross slope of the right screed section based on the determined crown profile and the determined cross slope, and display the crown profile and cross slope on the display device.

SUMMARY

The disclosure describes, in one aspect, a cross slope monitoring system for a paver having a screed assembly, a first tow point lift cylinder, and a second tow point lift cylinder. The system includes a first tow point lift cylinder sensor associated with the first tow point lift cylinder and configured to send a first signal indicative of the position of the first tow point lift cylinder, a second tow point lift cylinder sensor associated with the first tow point lift cylinder and configured to send a second signal indicative of the position of the second tow point lift cylinder, and a processor. The processor may be configured to determine the cross slope of the screed assembly based on the first signal and the second signal, to compare the determined cross slope to a cross slope threshold, and to generate a response if the determined cross slope is equal to or greater than the cross slope threshold.

The disclosure describes, in another aspect, a paver for distributing paving material onto a roadway surface, the paver having a traction unit, a screed assembly attached to the traction unit by a first tow arm and a second tow arm disposed on the opposite side of the traction unit from the first tow arm, a first tow point lift cylinder coupled to the first tow arm, the first tow point lift cylinder movable between an extended state and a retracted state, a second tow point lift cylinder coupled to the second tow arm, the second tow point lift cylinder movable between an extended state and a retracted state, and a cross slope monitoring system. The cross slope monitoring system having a first tow point lift cylinder sensor associated with the first tow point lift cylinder and configured to send a first signal indicative of the position of the first tow point lift cylinder, a second tow point lift cylinder sensor associated with the first tow point lift cylinder and configured to send a second signal indicative of the position of the second tow point lift cylinder, and a processor. The processor may be configured to determine the cross slope of the screed assembly based on the first signal and the second signal, to compare the determined cross slope to a cross slope threshold, and to generate a response if the determined cross slope is equal to or greater than the cross slope threshold.

The disclosure describes, in another aspect, a method for monitoring the cross slope of a screed assembly on a paver. The method includes receiving, by one or more processors, a first signal indicative of the position of a first tow point lift cylinder, receiving, by the one or more processors, a second signal indicative of the position of a second tow point lift cylinder, determining, by the one or more processors, a cross slope of the screed assembly based on the first and the second signals, comparing the cross slope of the screed assembly to a cross slope threshold, and generating a response based on the cross slope of the screed assembly being equal to or greater than the cross slope threshold.

BRIEF DESCRIPTION OF THE DRAWINGS

Further features and advantages of the invention will become apparent from the description of embodiments using the accompanying drawings. In the drawings.

DETAILED DESCRIPTION

This disclosure relates to a paver and a system that monitors the cross slope of a screed assembly of the paver. The present disclosure may be based in part on the realization that in some situations, such as for example, when the screed assembly is picked up while the paver is moved to a new location, portions of the screed assembly may be damaged due to the screed assembly being in cross slope. Cross slope is defined the torsional twist traverse to the direction of travel of the screed assembly and paver.

In accordance with the present disclosure, the paver may include a system that can determine the cross slope of the screed assembly and generate a response, such as provide an action (e.g., warning indication, control signal, etc.), based on the determined cross slope. For example, the system may determine that the screed assembly is in cross slope or that the cross slope is equal to or greater than a cross slope threshold. In response to the determined cross slope, the system may provide a warning to the operator and/or provide a signal to control the amount of cross slope.

Figure 1:
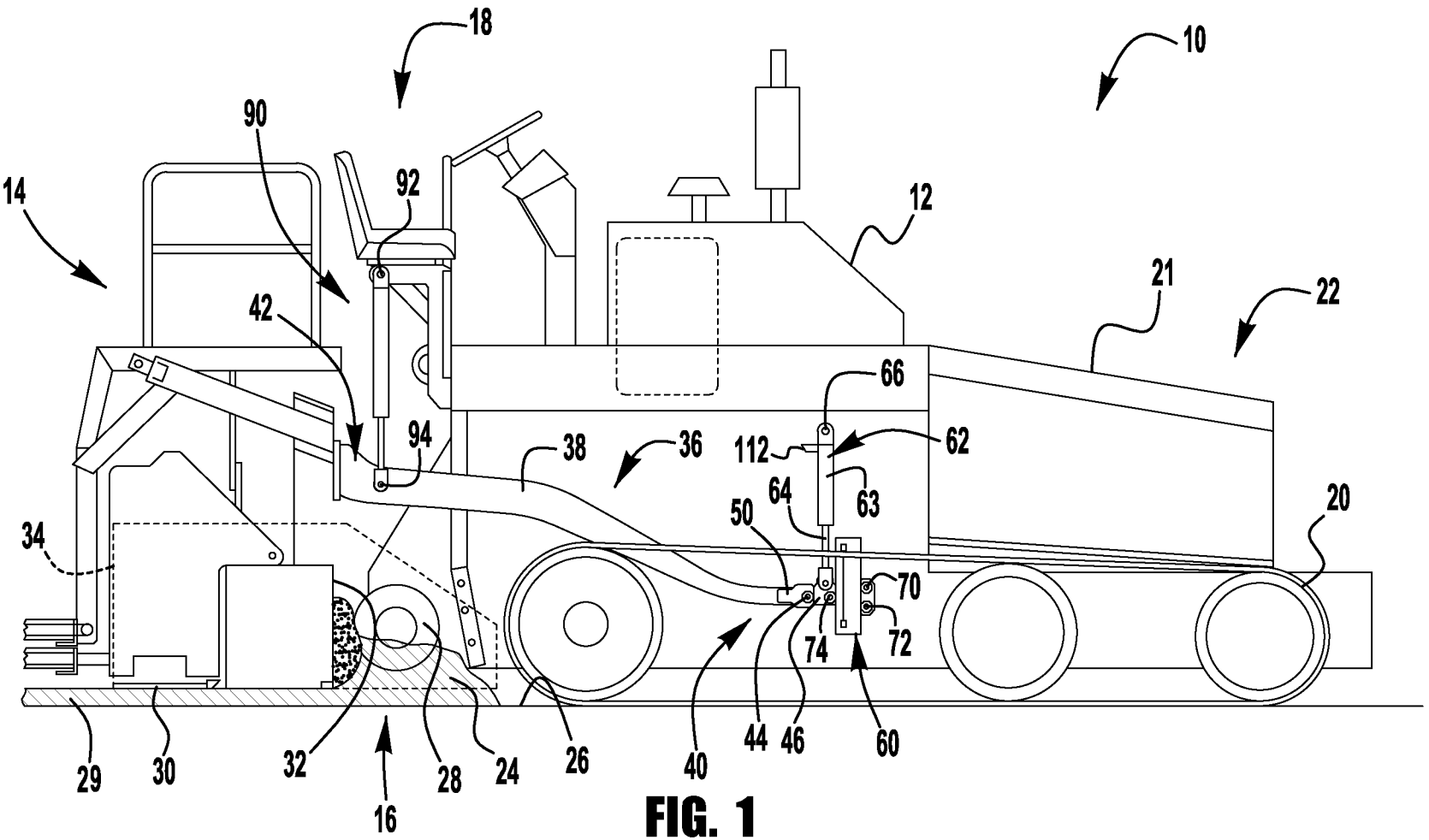
FIG. 1 is a side elevational view of an exemplary embodiment of a paver in accordance with aspects of the present disclosure, having tow point lift cylinder in a first position.

FIG. 1 shows a right side elevational view an exemplary embodiment of a paver 10 having a traction unit 12, such as tractor, with a screed assembly 14 disposed at a rearward portion 16 of the paver 10. The traction unit 12 provides the motive force for the paver 10, and typically includes an engine (not shown), an operator station 18, and ground engaging movers 20, such as tires or tracks.

The paver 10 may include a hopper 21 at a forward portion 22 of the paver 10 for storing a paving material 24, such as an asphalt material. The paver 10 may include a system for transporting the paving material 24 to the rearward portion 16 of the paver 10, such as for example, a conveyor system (not shown), typically including one or more longitudinally disposed conveyors. The paver 10 may include a system for spreading the paving material 24 out laterally on a roadway surface 26. In the illustrated embodiment, the system for spreading the paving material 24 includes one or more transverse screw augers 28 positioned at the rearward portion 16 of the paver 10 to deposit the paving material 24 onto the roadway surface 26 in front of the screed assembly 14.

The screed assembly 14 may be configured in a variety of ways. Any suitable configuration, whether known in the art or later developed, may be used. The screed assembly 14 may be a multiple section screed and may include extensions. In the illustrated embodiment, the screed assembly 14 may include an arrangement for vibrating one or more elements of the screed assembly 14 to enhance distribution, leveling and compaction of the paving material 24 into a finished asphalt mat 29. The screed assembly 14 may include a sole plate 30, a front plate 32, and an end gate 34 (shown in phantom in the interests of clarity), which are used to contain and level the deposited paving material 24 on the roadway surface 26. A thickness control (not illustrated) may be used by the operator to adjust the angle of inclination (i.e., "angle of attack") of screed sole plate 30 in order to adjust the thickness of the resulting asphalt mat 29. The thickness control may be of any appropriate arrangement and may include, for example, a rod and bearing arrangement.

Figure 3:
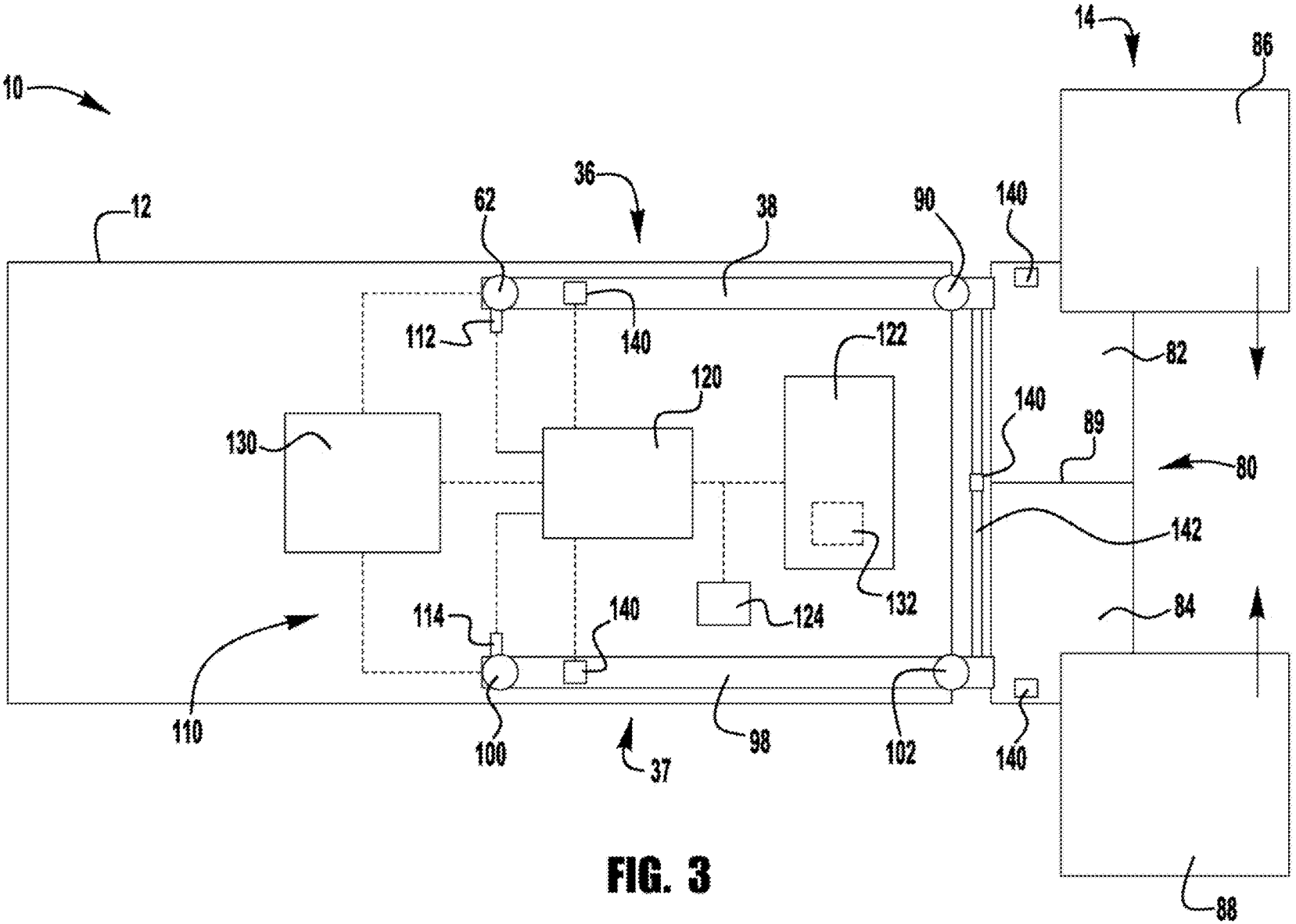
FIG. 3 is a schematic illustration a cross slope monitoring system for the paver of FIG. 1.

As shown in FIG. 3, in the illustrated embodiment, the screed assembly 14 includes a main screed section 80 having a right portion 82, a left portion 84, a first screed extension 86 provided behind and adjacent the right portion 82, and a second screed extension 88 provided behind and adjacent the left portion 84. The right portion 82 is connected to the left portion 84 along a main hinge 89. The screed extensions 86, 88 are slideably movable laterally, as shown by arrows in FIG. 3, between an extended position, as shown in FIG. 3, and a retracted position, such that varying widths of paving material can be laid. The lateral movement of the screed extensions 86, 88 may be driven by respective screed width actuators (not shown), such as hydraulic or electric actuators. The screed extensions 86, 88 may also tilt, slightly, relative to the main screed section 80.

Referring to FIG. 1, the illustrated screed assembly 14 is a floating type arrangement in which the screed assembly 14 is pivotably connected to the traction unit 12 by a first tow point assembly 36 disposed along the right side of the traction unit 12 and a second tow point assembly 37 (FIG. 3) disclosed along the left side of the traction unit 12. The second tow point assembly 37 is configured identical to the first tow point assembly 36, but for being on the opposite side of the traction unit 12 and arranged in mirror image. It will be understood that like elements coexist on the other side of the traction unit 12 in mirror image. Thus, the description of the first tow point assembly 36 applied equally to the second tow point assembly 37.

The first tow point assembly 36 includes a first tow arm 38 that has a forward end 40 and a rearward end 42. The rearward end 42 is coupled to the screed assembly 14, while the forward end 40 is coupled to the traction unit 12 at a tow point connection 44. The forward end 40 of the first tow arm 38 is pivotably connected to a tow point plate 46. While the first tow arm 38 may be a unitary structure in an alternate embodiment, the illustrated first tow arm 38 includes a mounting bracket 50 secured to the forward end 40 of the first tow arm 38.

The tow point plate 46 is coupled to the side of the traction unit 12 at both a tow point support 60 and a first tow arm lift mechanism, both of which are coupled to the traction unit 12. The first tow arm lift mechanism may be configured in a variety of ways. In the illustrated embodiment, the first tow arm lift mechanism is configured as a first tow point lift cylinder 62, such as a hydraulic or pneumatic cylinder, having a cylinder body 63 and a rod 64 axially movable relative to the cylinder body 63.

One end of the first tow point lift cylinder 62 is coupled to the tow point plate 46. The opposite end of the first tow point lift cylinder 62 is coupled to the traction unit 12 at connection point 66.

Further, the tow point plate 46 is slideably coupled to the side of the traction unit 12 by way of the tow point support 60. Grade sensors (not shown) connected to the paver 10 may send electrical signals to a system controller or valve (not shown) on the traction unit 12 to cause rod 64 of the first tow point lift cylinder 62 to retract or extend relative to the cylinder body 63, and in so doing raise or lower the tow point plate 46 relative to the tow point support 60, and, with the tow point plate 46, the first tow arm 38, and the screed assembly 14.

The tow point plate 46 is mounted to slide up and down relative to the tow point support 60 by three roller assemblies 70, 72, 74 rotatably coupled to the tow point plate 46. A first and a second roller assembly 70, 72 are disposed to roll along the forward edge of the tow point support 60, and a third roller assembly 74 is disposed along the rearward edge of the tow point support 60. In this way, the rearwardly directed force applied from first tow arm 38 is distributed between the first and second roller assemblies 70, 72 along the forward edge of the tow point plate 46. The third roller assembly 74 disposed along the opposite side of the tow point support 60 assists in leveling the tow point plate 46 while minimizing racking of the tow point plate 46 along the tow point support 60.

The first tow point assembly 36 may also include a first screed lift cylinder 90 configured to lift the screed assembly 14 vertically upward. The first screed lift cylinder 90 may be configured in a variety of ways. Any configuration capable of lifting the screed assembly 14 may be used. In the illustrated embodiment, the first screed lift cylinder 90 has a first end 92 attached to the traction unit 12 and a second end 94 pivotably attached to the first tow arm 38 near the rearward end 42 of the first tow arm 38.

As indicated above, the second tow point assembly 37 is configured identical to the first tow point assembly 36, and includes like elements to those described for the first tow point assembly 36, including a second tow arm 98, a second tow point lift cylinder 100, and a second screed lift cylinder 102 (FIG. 3).

Referring to FIG. 3, the paver 10 includes a cross slope monitoring system 110. The cross slope monitoring system 110 may be configured in a variety of ways, including the number of components, the type of components, the arrangement of components, and the like. Any system capable of determining the cross slope of the screed assembly 14 and generating a response, such as a warning, if the screed assembly 14 is in cross slope or the measured cross slope exceeds a cross slope threshold, may be used. The cross slope monitoring system 110 may determine the cross slope of the screed assembly 14 in a variety of ways.

In the illustrated embodiment, the cross slope monitoring system 110 may include a first cylinder position sensor 112, a second cylinder position sensor 114, an electronic or computerized control unit, module, or processor 120, one or more user interfaces 122, and, optionally, one or more signaling devices 124.

The first cylinder position sensor 112 may be associated with the first tow point lift cylinder 62. The first cylinder position sensor 112 may be configured in a variety of ways. Any sensing device capable of generating a signal indicative the position of first tow point lift cylinder 62 (i e., the amount that the rod 64 is extended or retracted relative to the cylinder body 63) may be used. The first cylinder position sensor 112 may be incorporated in design of the first tow point lift cylinder 62 or may be a separate component associated with the first tow point lift cylinder 62.

In one embodiment, the first cylinder position sensor 112 is a sensor positioned relative to the first tow point lift cylinder 62 to detect the position of the rod 64 relative to the cylinder body 63. By detecting the position of the rod 64 relative to the cylinder body 63, the relative height of the forward end 40 of the first tow arm 38 can be determined as well as the relative height of the right portion 82 of the screed assembly 14. The first cylinder position sensor 112 be suitable type of position sensor, such as for example, a magnetic sensor (e.g. Hall Effect), an inductive sensor (e.g., LVDT), a capacitive sensor, a resistive sensor, a pulse encoder, or any other suitable sensor.

In another exemplary embodiment, the first cylinder position sensor 112 is a pressure sensor positioned relative to the first tow point lift cylinder 62 to detect the pressure of fluid, such as hydraulic fluid, in the cylinder body 63 acting on the rod 64 or to detect the fluid pressure being delivered to the first tow point lift cylinder 62. The first cylinder position sensor 112 may be any suitable pressure sensor.

In yet another exemplary embodiment, in conjunction with or as an alternative to the first cylinder position sensor 112 and the second cylinder pressure sensor 114, the cross slope monitoring system 110 may include one or more slope sensors 140 capable of providing a signal indicative of the slope of the screed assembly 14. The one or more slope sensors 140 may be configured in a variety of ways. For example, the type of slope sensor, the number of slope sensors, and the location of the slope sensors may vary in different embodiments. FIG. 3 illustrates non-limiting examples of locations where slope sensors 140 may be placed to measure the slope of the screed assembly 14. For example, a slope sensor 140 may be positioned on each of the tow arms 38, 98, a slope sensor 140 may be positioned on each of the right portion 82 and the left portion 84 of the screed assembly 14, a slope sensor 140 may be positioned on a transverse beam 142 of the screed assembly 14, such as in the middle of the transverse beam, or one or more slope sensors 140 may be positioned in any other suitable location.

The processor 120 may be part of a paver control system adapted to monitor various operating parameters and to regulate various variables and functions affecting the operation of the paver. Alternatively, the processor 120 may be a specialized processor, separate from the paver control system. The processor 120 can be general purpose processor, a digital signal processor (DSP), application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor 120 may be any processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration. The processor 120 can include functions, steps, routines, data tables, data maps, charts and the like saved in and executed from any type of computer-readable medium, such as a memory device (e.g., random access, flash memory, and the like), an optical medium (e.g., a CD, DVD, BluRay®, and the like), firmware (e.g., an EPROM), or any other storage medium.

Although in the FIG. 3, the processor 120 is illustrated as a single, discrete unit, in other embodiments, the processor 120 and its functions may be distributed among a plurality of distinct and separate components. To receive signals and send signals, data, control demands, and instructions, the processor 120 is operatively associated and can communicate with various sensors, such as the first cylinder position sensor 112, the second cylinder position sensor 114, other system and controllers, and the user interface 122 on the paver 10, such as for example, a hydraulic system 130 of the paver 10. Communication between the processor 120 and the first cylinder position sensor 112, the second cylinder position sensor 114, the one or more user interfaces 122, and other systems, such as the hydraulic system 130, can be established by sending and receiving digital or analog signals across electronic communication lines or communication busses, including wireless communications. In FIG. 3, the various communication and command channels are indicated in dashed lines for illustration purposes.

In order to allow operators of the paver 10 to enter and receive information or commands concerning the cross slope of the screed assembly 14, the one or more user interfaces 122 may be provided that are in communication with the processor 120. For the convenience of operators, the user interfaces 122 may be located at various different locations on the paver 10. For example, one of the user interfaces 122 may be provided at the operator station 18 so as to be accessible to an operator sitting in the operator station 18, and one or more additional of the the user interfaces 122 may be arranged at another location on the paver 10 so as the be accessible to operators standing on the ground. Each of the user interfaces 122 may include one or more input devices (not shown), and one or more display devices 132 for displaying the configuration of one or more components of the paver 10, for example, the cross slope of screed assembly 14. The one or more input devices may be any type of input apparatus, and the one or more display devices 132 may also be any type of known display devices. In some embodiments, the input devices and display devices may be combined into a single device, for example, a touchscreen or the like.

The one or more display devices 132 may be configured to display a variety of information related to the cross slope of the screed assembly 14, such as for example, the determined cross slope, the position of the first tow point lift cylinder 62, the position of the second tow point lift cylinder 100, the cross slope set point, the cross slope threshold, an indication or warning that the determined cross slope exceeds the cross slope threshold, or other cross slope related information. The user interface 122 may also be configured for allow an operator to respond to the information being provided. For example, the operator may be able to respond to an indication or warning that the determined cross slope exceeds the cross slope threshold by acknowledging or disabling the indication or warning.

The one or more signaling devices 124 of the cross slope monitoring system 110 may be located separate from the one or more display devices 132 or separate from the user interface 122. The one or more signaling devices 124 may be configured in a variety of ways. Any signaling devices 124 capable of providing a warning indication to a person on or near the paver 10 may be used. For example, one or more signaling devices 124 may be located on the user interface 122 but separate from the one or more display devices 132 or may be located spaced apart from the user interface 122, such as at a location proximate the operator station 18, at a location on the paver 10 but distal from the operator station 18, or at a location remote from the paver 10.

The one or more signaling devices 124 may be configured to provide any suitable warning indication, such as, for example, a visual indication, an audio indication, a tactile indication (e.g., a vibration), or a combination thereof. In one embodiment, the one or more signaling devices 124 includes a noise producing device, such as a siren, buzzer, or the like. In another embodiment, the one or more signaling devices 124 includes a warning light.

Figure 4:
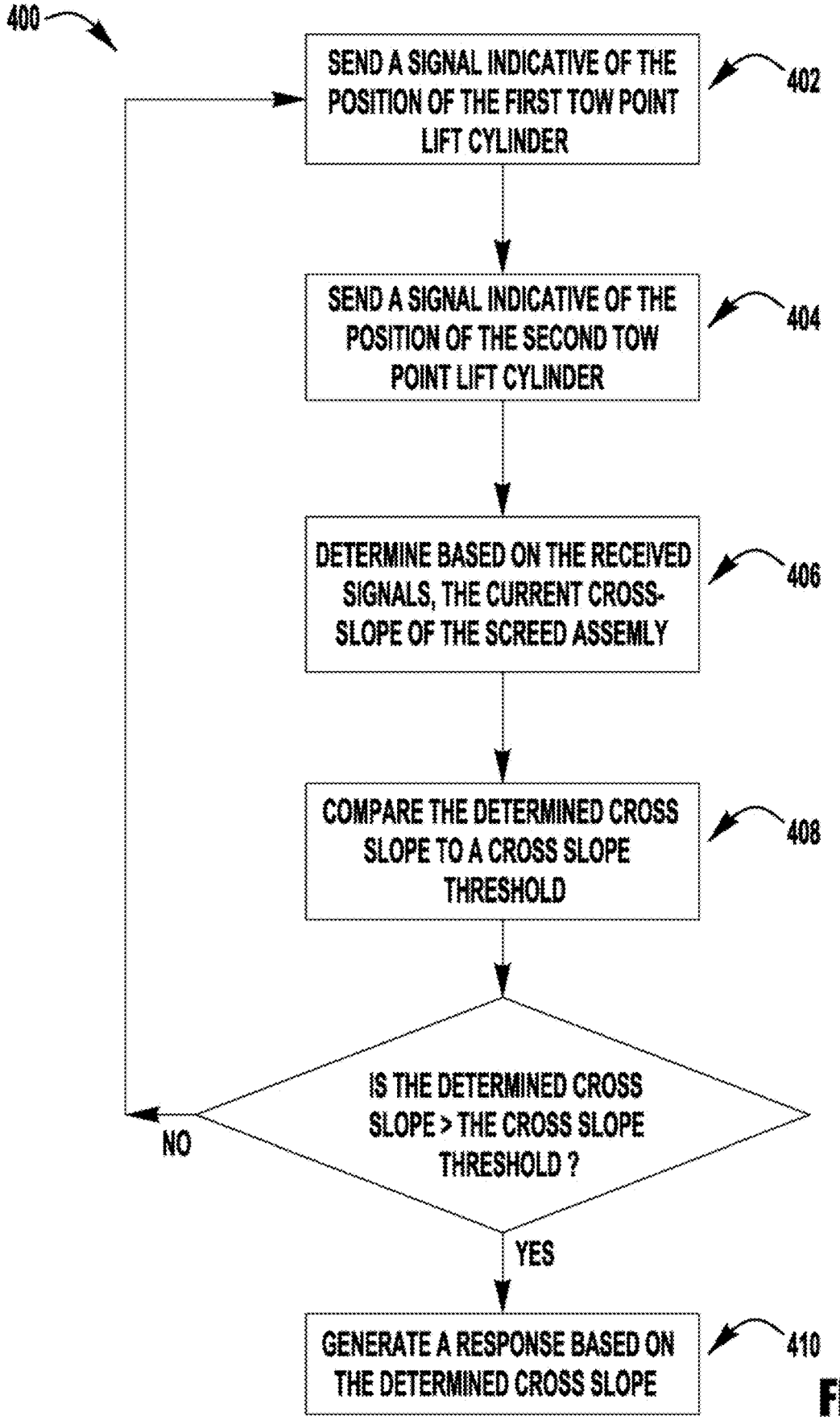
FIG. 4 is a flow diagram of a method for monitoring cross slope of the paver of FIG. 1.

Referring to FIG. 4, an exemplary operation of the cross slope monitoring system 110 in accordance with the present disclosure is described in more detail. During operation of the paver 10, whether the paver is moving or stationary, the cross slope monitoring system 110 can generate a response based on the determined cross slope.

In one exemplary method, in step 402, the first cylinder position sensor 112 sends a signal indicative of the position of the first tow point lift cylinder 62 and, in step 404, the second cylinder position sensor 114 sends a signal indicative of the position of the second tow point lift cylinder 100.

The processor 120, in step 406, receives the signals from the first cylinder position sensor 112 and the second cylinder position sensor 114 and, using the inputs from one or both of the first cylinder position sensor 112 and the second cylinder position sensor 114, determines the current cross slope of the screed assembly 14. For example, the processor 120 may be configured to determine the cross slope based on the position of the first tow point lift cylinder 62 and the second tow point lift cylinder 100.

The processor 120, in step 408, compares the determined cross slope to a cross slope threshold. The cross slope threshold, may be a predetermined value or values of cross slope stored in the memory of the processor 120, or the memory of another device, which the processor 120 may retrieve the threshold value from. For example, the cross slope threshold may be determined from physical testing of the screed assembly and paver. Due to differences in screed assemblies, pavers, and operating environments, the cross slope threshold range may vary with different embodiments. In some embodiments, the processor 120 may calculate a cross slope threshold value based on various operating parameters of the paver 10 prior to or at the time of receiving the signals from the first cylinder position sensor 112 and the second cylinder position sensor 114.

The cross slope threshold may also vary based on the operating mode of the paver 10 and screed assembly 14. For example, the paver 10 may operating in a paving mode where the paver 10 is applying paving material and may operate in a travel mode where the screed assembly 14 is lifted and the paver 10 is not applying paving material while is moving between paving locations. The cross slope threshold, for example, may be larger during the paving mode, where cross slope may be needed, than during the traveling mode, where cross slope is not needed or desired.

In step 410, if the determined cross slope is equal to or greater than the cross slope threshold, the processor 120 may generate a response. Whether or not the processor 120 generates a response may also be conditioned on one or more additional variables, such as for example, whether the screed lift cylinders 90, 102 have been actuated.

The processor 120 may take one or more actions based on the determined cross slope and the cross slope threshold. The actions that the processor 120 takes can vary in different embodiments and during different operating modes of the paver 10. For example, in one embodiment, the processor 120 may send a warning indication to the user interface 122 to display on the one or more display device 132. The warning indication can be a warning message or other indication that the current cross slope of the screed assembly 14 is equal to exceeds the cross slope threshold. The warning indication may take any suitable form, including visual and audio. For example, the warning indication may be to highlight respective indicators on the one or more display devices.

In the alternative to, or in conjunction with, displaying a warning indication on the display device, a warning indication may be displayed in other suitable locations, such as for example, a visual or audio warning on the user interface separate from the display device or separate from the user interface. For example, the processor may activate the one or more signaling device 124 to provide a warning to the operator. Still further, the processor 120 may send a warning message or indication to a remote location, such as a remote computer, terminal, or operator, indicating that the determined cross slope is equal to or greater than the cross slope threshold.

The cross slope monitoring system 110 may be configured to allow the operator to provide an input to the system in response to the warning indication. For example, in one embodiment, the user interface may be configured to allow the operator to override or acknowledge warning indication. The operator may provide the input in a variety of ways. Any suitable input may be used, such as manual manipulation of a button or switch, actuation of a button, icon, or the like on a computer or touch screen, a verbal acknowledgement, or any other suitable input.

In some embodiments, the response generated by the processor 120 may limit or prevent the cross slope from further increasing, may reduce the cross slope below the threshold, or may remove all cross slope from the screed assembly 14. For example, the processor 120 may send a control signal to a controller to control the cross slope or may directly control the cross slope. In one exemplary embodiment, the processor 120 sends signal to the hydraulic system 130 on the paver 10, or a controller of the hydraulic system, that prevents the hydraulic system from further actuating one or both of the first tow point lift cylinder 62 and the second tow point lift cylinder 100. The signal, may for example, block hydraulic fluid flow to the tow point lift cylinders 62, 100, disable a manual input device, such as a button on the user interface, to prevent an operator from further actuating the lift cylinders, automatically control the hydraulic system to reduce the cross slope, or another suitable way that prevents the cross slope from further increasing or results in the cross slope decreasing.

INDUSTRIAL APPLICABILITY

The present disclosure is applicable to pavers 10. Embodiments of the disclosure may provide a warning indication, and/or other actions, in response to the cross slope of the screed assembly 14. In operation, when the traction unit 12 is moving forward, the screed assembly 14 is pulled behind the traction unit 12. During the paving mode, there are situations when the screed assembly 14 may need to be placed in cross slope. For example, the screed assembly 14 will typically be placed in cross slope during a continuous pull transitioning from paving straight to going around a corner. During typical paving operations, the screed lift cylinders 90, 102 are not pressurized, thus, the screed lift cylinders 90, 102 provide no resistance to the screed assembly 14 floating freely as screed assembly 14 follows the contour of the roadway surface 26.

Figure 2:
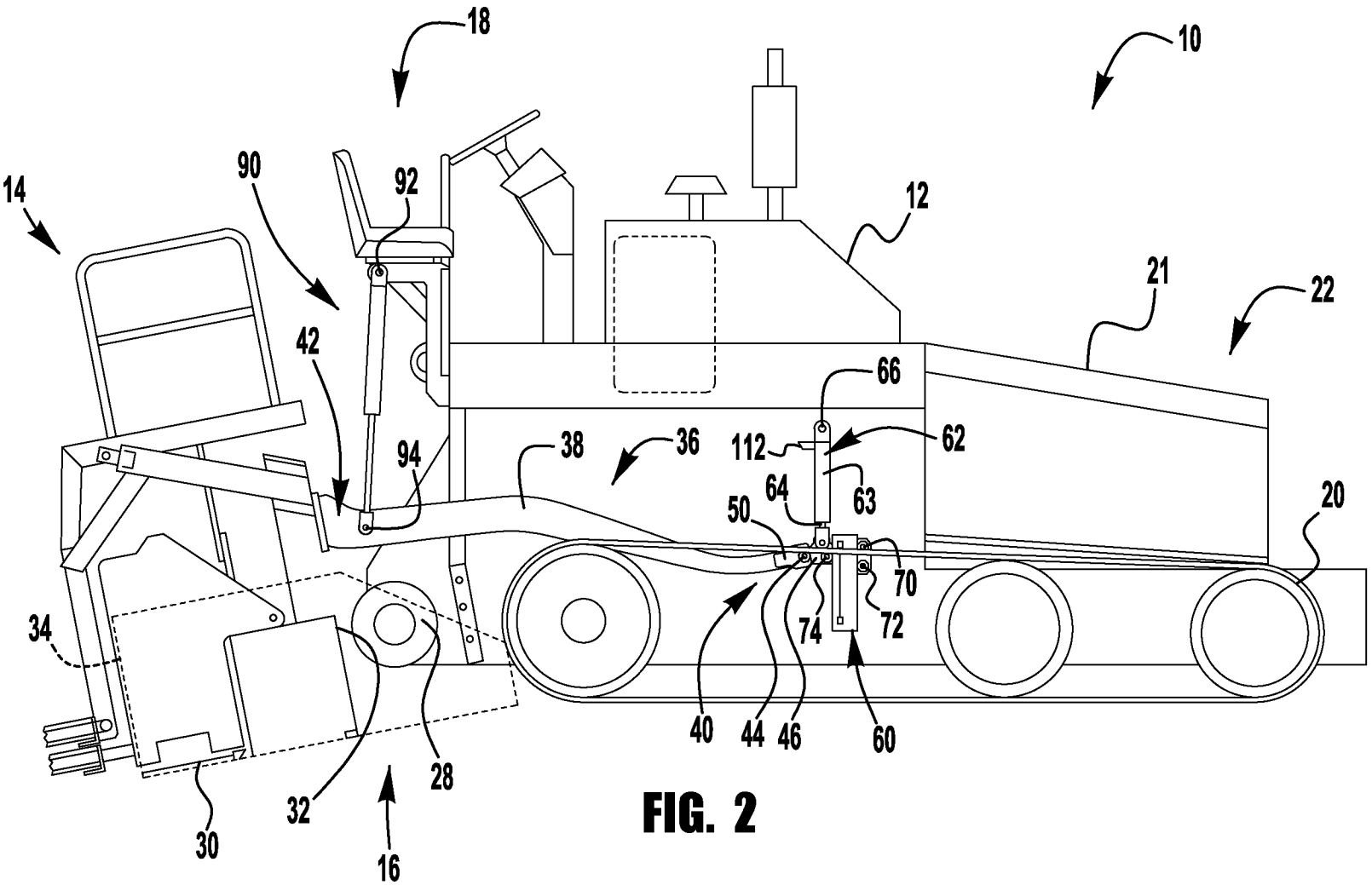
FIG. 2 is a side elevational view of the paver of FIG. 1, having tow point lift cylinder in a second position.

Placing the screed assembly 14 in cross slope, however, can damage the screed assembly 14, in some situations, such as for example, when the screed assembly 14 is also lifted by the screed lift cylinders 90, 102. To move the paver 10 between paving locations, the screed assembly 14 is placed in travel mode where, typically, the screed assembly 14 is lifted upward to disengage from the roadway surface 26. To lift the screed assembly 14, the screed lift cylinders 90, 102 are actuated and moved to a retracted position. FIG. 1 illustrates the paver 10 with the first tow point lift cylinder 62 in a first extended position and FIG. 2 illustrates the paver with the right tow point lift cylinder 62 in a retracted position. It is apparent from comparing FIG. 1 to FIG. 2, that if the right tow point lift cylinder 62 is in the position of FIG. 1 and the second tow point lift cylinder 100 is in the potion of FIG. 2, the right portion 82 and first extension 86 of the screed assembly 14 will be biased to an orientation that is significantly different than the left portion 84 and the second extension 88.

It will also be understood, that when the screed lift cylinders 90, 102 are actuated, the screed lift cylinders 90, 102 tend to lift the right portion 82 and left portion 84 of the screed assembly 14 to the same height relative to the traction unit 12. If the screed assembly 14 is still in cross slope while the screed lift cylinders 90, 102 lift the screed assembly 14, the screed assembly 14 will twist.

The twisting of the screed assembly 14 can damage the screed assembly 14. For example, the main hinge 89 that connect the right portion 82 of the main screed section 80 to the left portion 84 can be damaged by the twisting of the screed assembly 14. In addition, the screed extensions 86, 88, when extended, tilt relative to the main screed section 80. The twisting of the screed assembly 14 can result in one or more of the screed extensions 86, 88 contacting other components of the screed assembly 14, such as line connects, electronics, or other similar components, resulting in damage to those components.

The cross slope monitoring system 110, however, can provide a warning indication to an operator that the screed assembly 14 is in cross slope or exceeds a cross slope threshold. The operator can then determine if the cross slope is appropriate for the situation and take action accordingly. For example, if the screed assembly is in cross slope and the screed assembly is about to be lifted as the paver is moved to a new location, the warning indication from the cross slope monitoring system 110 alerts the operator and the operator can change the cross slope. Alternatively, the processor 120 may recognize, based on the operating parameters of the paver and/or input from the operator, that the paver is in situation where the cross-slope, or the current amount of cross-slope, may cause damage, and the processor may automatically reduce the cross slope or prevent further increase to the cross slope.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A cross slope monitoring system for a paver having a screed assembly, a first tow point lift cylinder, a second tow point lift cylinder, and one or more screed lift cylinders that lift the screed assembly when the paver is in a travel mode, the system comprising:

a first tow point lift cylinder sensor associated with the first tow point lift cylinder and configured to send a first signal indicative of the position of the first tow point lift cylinder;

a second tow point lift cylinder sensor associated with the second tow point lift cylinder and configured to send a second signal indicative of the position of the second tow point lift cylinder and;

a processor configured to:

determine the cross slope of the screed assembly based on the first signal and the second signal;

compare the determined cross slope to a cross slope threshold for the screed assembly when lifted in the travel mode; and generate a response only if the determined cross slope is equal to or greater than the cross slope threshold.

2. The cross slope monitoring system according to claim 1, wherein generating a response comprises sending a warning indication.

3. The cross slope monitoring system according to claim 2, further comprising a user interface configured to display the warning indication on a display device.

4. The cross slope monitoring system according to claim 1, wherein the first tow point lift cylinder includes a cylinder body and a rod movable relative to the cylinder body, wherein the first signal is indicative of the position of the rod relative to the cylinder body.

5. The cross slope monitoring system according to claim 1, wherein the first signal is indicative of the hydraulic fluid pressure within or delivered to the first tow point lift cylinder.

6. The cross slope monitoring system according to claim 1, wherein generating a response comprises sending a control signal to reduce the cross slope of the screed assembly.

7. A paver for distributing paving material onto a roadway surface, the paver comprising: a traction unit;

a screed assembly attached to the traction unit by a first tow arm and a second tow arm disposed on the opposite side of the traction unit from the first tow arm;

a first tow point lift cylinder coupled to the first tow arm, the first tow point lift cylinder movable between an extended state and a retracted state;

a second tow point lift cylinder coupled to the second tow arm, the second tow point lift cylinder movable between an extended state and a retracted state;

one or more screed lift cylinders that lift the screed assembly when the paver is in a travel mode; and a cross slope monitoring system comprising:

a first tow point lift cylinder sensor associated with the first tow point lift cylinder and configured to send a first signal indicative of the position of the first tow point lift cylinder;

a second tow point lift cylinder sensor associated with the first tow point, lift cylinder and configured to send a second signal indicative of the position of the second tow point lift cylinder, and a processor configured to:

determine the cross slope of the screed assembly based on the first signal and the second signal;

compare the determined cross slope to a cross slope threshold for the screed assembly when lifted in the travel mode; and generate a response only if the determined cross slope is equal to or greater than the cross slope threshold.

8. The paver according to claim 7, wherein generating a response comprises sending a warning indication.

9. The paver according to claim 8, further comprising a user interface configured to display the warning indication on a display device.

10. The paver according to claim 7, wherein the first tow point lift cylinder includes a cylinder body and a rod movable relative to the cylinder body, wherein the first signal is indicative of the position of the rod relative to the cylinder body.

11. The paver according to claim 7, wherein the first signal is indicative of the hydraulic fluid pressure within or delivered to the first tow point lift cylinder.

12. The paver according to claim 7, wherein generating a response comprises sending a control signal to reduce the cross slope of the screed assembly.

13. A method for monitoring the cross slope of a screed assembly on a paver when the screed assembly is lifted in a travel mode, the method comprising:

receiving, by one or more processors, a first signal indicative of the position of a first tow point lift cylinder;

receiving, by the one or more processors, a second signal indicative of the position of a second tow point lift cylinder;

determining, by the one or more processors, a cross-slope of the screed assembly based on the first and second signals;

comparing the cross slope of the screed assembly to a cross slope threshold for the screed assembly when lifted in the travel mode; and generating a response only if the cross slope of the screed assembly is equal to or greater than the cross slope threshold.

14. The method of claim 13, wherein generating a response comprises sending a warning indication.

15. The method of claim 13, wherein the first signal indicative of the position of a first tow point lift cylinder is received via a position sensor associated with the first tow point lift cylinder.

16. The method of claim 13, wherein the response comprises one or more of an audible indicator and a visual indicator.

17. The method of claim 13, further comprising determining a cross slope threshold.

* * * * *